US006481014B1

(12) United States Patent
Banks et al.

(10) Patent No.: US 6,481,014 B1
(45) Date of Patent: Nov. 19, 2002

(54) COOLER WITH INTEGRAL BEVERAGE RETAINERS

(76) Inventors: Jesse Banks, 749 Spooner Rd., Virginia Beach, VA (US) 23462; Dennis Travis, 641 Minuteman Rd., Virginia Beach, VA (US) 23462

( * ) Notice: Subject to any disclaimer, the term of this patent is extended or adjusted under 35 U.S.C. 154(b) by 0 days.

(21) Appl. No.: 10/010,683

(22) Filed: Dec. 5, 2001

(51) Int. Cl.[7] ..... F25D 3/08
(52) U.S. Cl. ..... 1/15; 62/457.5
(58) Field of Search ..... 62/457.4, 457.5, 62/372

(56) References Cited

U.S. PATENT DOCUMENTS 4,280,336 A * 7/1981 Taylor ..... 206/541
4,704,875 A * 11/1987 Kieler ..... 220/555
4,899,553 A * 2/1990 Drummond, III ..... 62/372
5,247,798 A * 9/1993 Collard, Jr. ..... 221/266
6,067,816 A * 5/2000 Hodosh ..... 220/592.17
6,360,558 B1 * 3/2002 Woog ..... 206/141

* cited by examiner

*Primary Examiner*—William E. Tapolcai
(74) *Attorney, Agent, or Firm*—David J. Bolduc

(57) ABSTRACT

The present invention relates to a cooler having a plurality of beverage container holders that are adapted for retention of a beverage in a plurality of positions. More specifically, the beverage container holders are adapted to be placed and secured in a stowed position wherein the beverage container is retained within the ice chest. Also available is an extended position outside the ice chest wherein a beverage container may be inserted and retained. This design allows an open or closed beverage container to be inserted into the retainer in the extended position and then returned to the stowed position allowing the beverage to remain cool and free of foreign materials or organisms.

15 Claims, 7 Drawing Sheets

COOLER WITH INTEGRAL BEVERAGE RETAINERS

BACKGROUND OF INVENTION

1. Field of Invention

The present invention relates generally to coolers and ice chests. More specifically, the present invention relates a cooler device adapted to keep both opened and closed beverage containers both cool and contaminant free, while permitting easy access to the beverage containers.

2. Description of Prior Art

When people leave home to engage in recreational activities, such as at the park or the beach, they usually take food and beverages along with them. The food and beverages are frequently stored in a refrigerator or a cooler, for example, to bring the beverage to a desired temperature for consuming the beverage. Many beverages are packaged for sale in a bottle or can (beverage container). Upon removal of the beverage container from the cooling source, the beverage in the container changes temperature over time. Further, during consumption of the beverage, the drinker's body temperature, transmitted through the hand holding the container, also changes the temperature of the beverage over time.

In the prior art, to maintain the beverage in the container at the desired temperature for a longer period of time, a sleeve made from thermally insulative material can be provided to store the container during transportation and/or consumption. Various types of insulative sleeves and other insulators are well known in the art. An "Insulated Bag" is detailed in Design Pat. No. 281,546 to Charlotte S. Bradshaw. The insulated bag includes a body portion having a pair of upward-standing handles and a closure at the top for receiving cold or hot food or beverages and maintaining the food or beverages in a hot or cold condition, as desired. U.S. Pat. No. 315,477 to Michael W. Shearer, details a "Refrigerated Totebag". The refrigerated totebag is characterized by a flexible, resilient body portion having a drawstring at the top thereof for tightening around a bottle and a handle built into the side portion of the body for carrying purposes.

The insulative sleeve has some drawbacks, however. The insulative sleeve typically is a cylinder that encircles the container. Necessarily, the sleeve has a larger diameter than the container. A user may have difficulty in grasping the sleeve because the size of the sleeve is too large for his or her hand to grip comfortably. Often, the sleeve is made from a material that provides little frictional resistance when gripped, further increasing the difficulty of grasping the holder.

Further, the insulative sleeve is frequently used to transport and consume a beverage outside. Once a container is opened, insects, such as bees, and debris can enter the container and foul the beverage. Insects pose an acute problem because they are often drawn to the sugar and other substances found in soft drinks. In the case where a bee enters a container, the bee is likely to sting a person drinking from the container, potentially resulting in serious injury to the person. The prior art sleeve can not prevent insects and debris from entering the container.

Another very popular type of beverage container cooler is a portable carrier, such as carriers sold under the name PLAYMATE and the trademark IGLOO by Stalnaker Plastics located at 3102 Kiowa Street, Fort Worth, Tex. These coolers typically have sloped outer surfaces or have separate trays that can be attached to the sloped surface.

The sloped outer surfaces of these coolers are not convenient for placement of a beverage container while beverage is being consumed. A separate tray or small table can be brought along for such a purpose but such an item is often inconvenient to store while traveling. Such an item is difficult to keep level on uneven ground or sand and does not generally provide a secure place for food or drink if the item is moved even slightly from a level position. This is especially true for beverage containers, which can easily become slippery due to moisture condensation on their outer surfaces. In addition, such an item for placement of beverage containers is usually not inexpensive and can be easily misplaced. Furthermore, such an item does not prevent the beverage from becoming warm or prevent insects and debris from entering the container.

Examples of other patented devices in this field include those disclosed in the following U.S. Pat. No. 415,980 (Sachs); U.S. Pat. No. 662,541 (Miskololzy); U.S. Pat. No. 2,648,954 (Wheeler et al); U.S. Pat. No. 2,979,227 (Norton et al); U.S. Pat. No. 4,295,345 (Atkinson). The unit is frozen and placed on the necks of the bottles to be kept cool. The Norton et al patent discloses a container for keeping a six-pack of bottled beverages cold. Crushed ice is placed around the bottles in the container. The Atkinson patent discloses a cooling container for keeping cans cold including a top section having a slow warming cooling gel contained therein. The Wheeler et al patent discloses a refrigerated carton including circular compartments. Dry ice is placed in the partitions between the compartments. The Sachs patent discloses a portable cooler for drinking glasses including cone-shaped partitions for receiving the bottles to be cooled. The Miskoloczy patent discloses a frozen container for keeping beverages cold.

While these prior beverage holders are known, these holders do not maintain the beverage in a cool state nor prevent foreign contamination of the beverage.

SUMMARY OF THE INVENTION

The present invention is directed to an improved cooler. As mentioned herein above, one of the problems associated with maintaining food and beverage containers of any description in a cool condition after removal from a refrigerator or ice chest, is that of rapid heating of the container contents, sometimes causing spoilage. Another problem is that of contamination of the beverage by foreign objects including dirt and insects. In view of the foregoing disadvantages inherent in present coolers, the solution to the problem takes the form of an improved cooler that keeps beverages cool before and after opening the container while protecting the beverage from foreign contamination.

In accordance with one aspect of the invention, a cooling device is provided which is both simple and inexpensive and which overcomes the basic problems with prior art cooling methods and devices. In a preferred embodiment, the cooler includes an insulating chest insulating the interior of the chest from its warmer surroundings, and within which is located ice or another cooling medium. Along the exterior of the cooler are located receptacles capable of receiving beverage containers. Each of the receptacles also provides insulation between the interior of the receptacle from its warmer surroundings at the exterior.

Each of the receptacles may be placed in one of two positions: stowed or extended. To facilitate the dual positions the receptacles are adapted to be extended and retracted between the two positions such as by hinges or other extension means. In the extended position, a closed or open beverage may be placed in the receptacle. The receptacle may then be closed into the stowed position. In the stowed position, the exterior of the beverage container is placed in contact with a cooling medium either directly or by conduction through air or a rigid or semi-rigid membrane. While in the closed position, the beverage container is also protected from foreign contamination.

Accordingly, in view of the foregoing problems of the prior art, an object of this invention to provide a new and improved insulated cooler for bottles, cans and other food, beverage and milk containers.

It is another object of the invention to provide an insulated cooler for receiving a frozen refrigerant for contacting and maintaining the contents of the bottle, can or alternative container in a cool condition.

It is another object of the invention to provide an insulated cooler having a liner therein adapted to receive a frozen refrigerant, wherein the liner is adapted for contacting and maintaining the contents of the bottle, can or alternative container in a cool condition by conduction through the liner.

It is another object of the invention to provide an insulated cooler fitted with insulated receptacles that facilitate free standing of the container for contact with a frozen refrigerant thereby maintaining the contents of the insulated receptacle in a cool condition.

A still further object of this invention is to provide an insulated cooler having insulated receptacles having a stowed and extended position.

It is another object of the invention to provide an insulated cooler fitted with insulated receptacles that facilitate stably and conveniently placing a free standing open or closed container in the receptacle while in the extended position.

It is another object of the invention to provide an insulated cooler fitted with insulated receptacles that facilitate stably and conveniently placing a free standing open or closed container in the receptacle in the receptacle while in the extended position and then closing the receptacle to the stowed position, placing the container between the insulation layer and the liner thereby keeping the contents of the container cool by conduction.

DETAILED DESCRIPTION OF THE INVENTION

Figure 1:
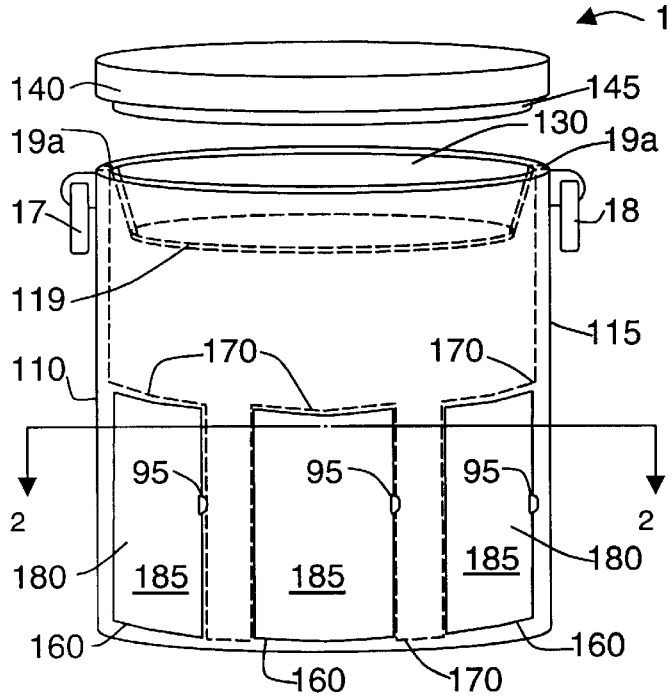
FIG. 1 is an elevation view of a cylindrical cooler constructed in accordance with the preferred embodiment of the invention showing the interior lining in ghost.

The above, and other objects, features, and advantages of the present invention will become apparent from the following detailed description of illustrated embodiments thereof to be read in conjunction with the accompanying drawings, in which like reference numerals represent the same or similar parts.

The above described drawing figures illustrate the invention, a cooler apparatus having one or more outer walls and a bottom wall forming a container having a top opening on which can be secured a lid. The walls and lid have an insulating medium to prevent heat transfer between the container interior and the exterior environment. Within the container is a liner, into which may be placed a cooling medium such as ice, cold water, frozen gel packs or other similar cooling fluids and media. The space between the liner and the outer walls of the container form compartments, in which a beverage container can be stored. There is an aperture in the outer wall adjacent each compartment, in which is a beverage container holder adapted to be pivotably mounted. The beverage container holder may be alternately extended from the compartment or stored securely within the compartment. A beverage container stored within the compartment is thereby placed in physical contact with the interior liner and therefore in thermal contact with the cooling medium by conduction through the liner.

Figure 2:
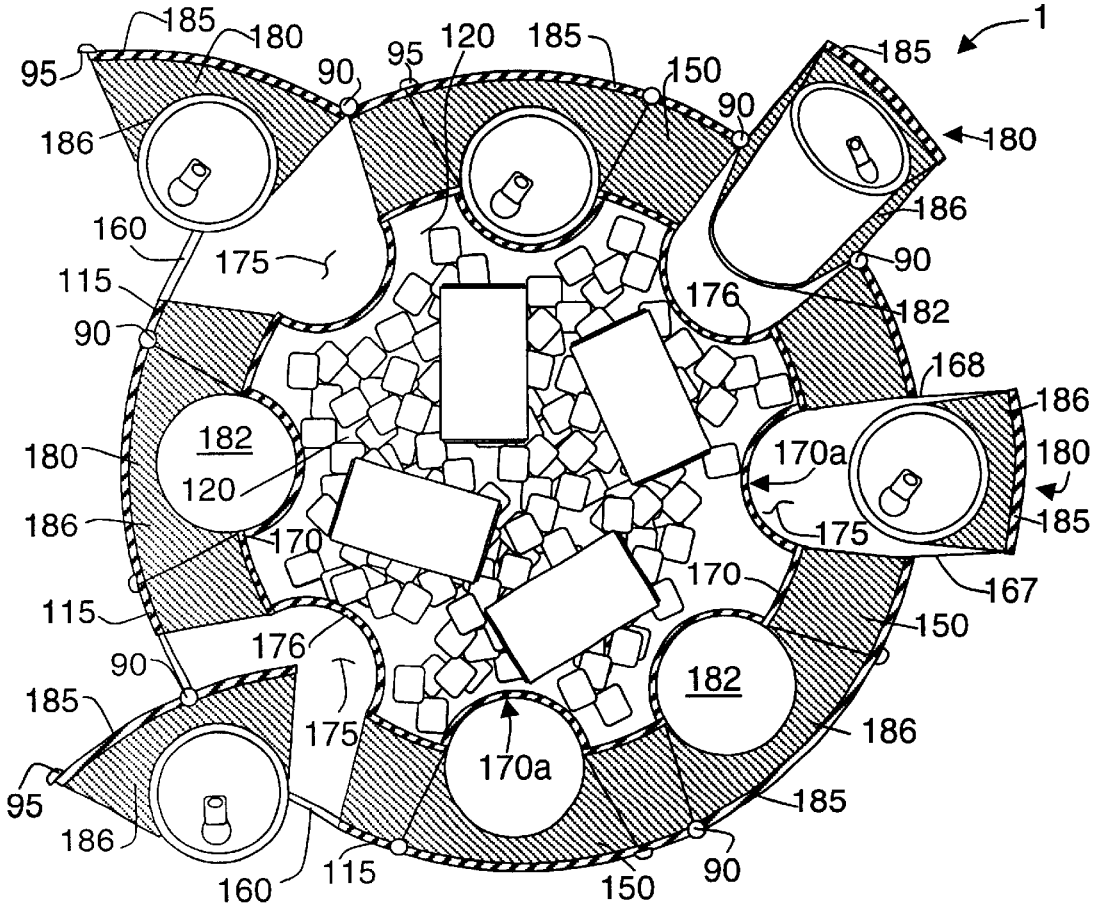
FIG. 2 is a plan view of the cooler along line 2—2 of FIG. 1 showing an interior liner, beverage storage compartments and several beverage container holders in stowed and extended positions.

Referring to FIGS. 1 and 2: The preferred embodiment of the cooler 1 depicted in FIGS. 1 and 2 is representative of a cooler 1 having an insulated container 110 comprising a bottom wall 112 with a vertical sidewall 115 rising substantially perpendicularly from the bottom wall periphery. In the preferred embodiment, the cooler 1 has a rectangular cross-section in elevation with a substantially circular cross-section in the plan view, i.e., a substantially cylindrical cooler 1. Specifically, the cooler 1 includes an insulated container 110 having a circular bottom wall 112 with a substantially cylindrical sidewall 115 extending perpendicularly, i.e., upwardly therefrom. The sidewall 115 is integral with and perpendicular to the bottom wall 112. These walls 112 and 115 are joined at their respective peripheries to form an essentially cylindrical container 110 configured to form an enclosure defining a volume 120 and having a top access opening 130 therein.

The container 110 is preferably made of a rigid high density plastic. More specifically, the container walls 112 and 115 are preferably constructed of a durable, liquid non-permeable and thermally insulative material such as polyurethane, thermoplastic and other durable materials. Preferably the container 110 is of unitary construction by means of molding such as cast or injection molding of thermoplastic materials.

The container 110 also comprises a lid 140 adapted for removable attachment to and covering of the upper container access opening 130. The lid 140 is adapted to fit within the upper container access opening 130, such adaptation being a tight frictional fit wherein a side flange 145 of the lid 140 fits over, and in contact with the interior of the container side wall 115. The lid 140 is also constructed of a durable, liquid non-permeable and thermally insulative material such as rigid high density plastic, polyurethane, thermoplastic and other durable materials and combinations thereof. Preferably the lid 140 is of unitary construction by means of molding such as injection molding of thermoplastic materials. The lid 140 may also comprise a thermoplastic material as a shell formed around an insulative material such as solid, foam or even gaseous insulation therein. The lid 140 may further be removable from the container access opening 130 as shown or may be otherwise removably attached with hinges, straps or the like (not shown). The lid 140 is preferably of substantially solid construction to allow the lid 140 to have significant weight rested thereon for use as a table or chair and the like.

The cooler 1 may have handles 17 and 18 attached to the exterior sidewall 115. These handles 17 and 18 may be of the types that are rotatably mounted to the upper part of the sidewall 115 to rotate away from the sidewall 115 for gripping the handles 17 and 18 without contacting the exterior surface of the container 110. Alternatively the handles 17 and 18 may be integrally molded grip holes (not shown) in the sidewall 115 of the container 110. Additional handles (not shown) may also mounted on the exterior sidewall 115 of the container 110 on either the upper lower or central portions of these sidewall 115, or even on the lid 140.

The cooler 1 may also have a removeable tray 119 therein for dry storage of items. Preferably, the tray 119 may be placed into the interior volume 120 of the container 110 by means of the access opening 130. The tray 119 may therefor be placed in thermally conductive contact with the a cooling medium within the container 110 while keeping the contents of the tray 119 away from direct contact with the cooling medium, which may wet goods desired to be kept dry. To this end, the tray may be a solid tray that may be placed onto the cooling medium. Most preferably, the tray comprises a rack which has opening allowing the cool air with the container to freely pass. The rack preferably has a lip 19*a* which allows the rack to be suspended from the sidewall 115 about the access opening 130. By having a hanging rack 119, dry goods may be stored above and out of reach of the beverages and other items in the cooling medium, while maintaining the dry goods in cooled air within the container 110. The rack 119 preferably hangs from the interior side walls 115 at the access opening 130 without the lip 119*a* interfering with placement of the lid 140 in the access opening 130.

The container 110 preferably has a thermally insulative layer 150 attached to the interior of sidewall 115. A thermal insulator 150 may also line the bottom wall 112 of the container 110. The thermally insulative layer 150 provides additional thermal insulation between the interior volume 120 of the container 110 and the external environment. Exemplary thermal insulators include lightweight foam insulation such as STYROFOAM. The insulation 150 interior to the container 110 may also comprise the sidewall 115 formed as a thermoplastic shell around an insulative material such as solid, foam or even gaseous insulation therein.

Referring again to FIGS. 1 and 2: The exterior wall 115 of the container 110 has one or more apertures 160 therein. More specifically, the aperture 160 comprises a hole forming a door-like opening extending from the exterior environment through the wall 115 and through the insulative layer 150 and towards the central volume 120 of the container 110. For example, as shown in FIG. 1, the wall 115 of the container 110 has a substantially rectangular aperture 160 extending therethrough. Preferably, the aperture 160 is large enough to place a standing beverage container therethrough. Furthermore, it is preferred that the aperture 160 extends through the sidewall 115 in close proximity to the bottom wall 112. This allows a container to be placed in through the aperture 160 with the bottom wall 112 providing additional support to the beverage container or the container holder 180 thereon, discussed herein below.

The container 110 further comprises an interior liner 170 adjacent the insulator layer 150 and the apertures 160. More specifically, the interior liner 170 preferably comprises a thin layer of liquid impermeable, thermally conductive material in contact with the interior surface of the insulator layers 150. The liner 170 is also in contact with the bottom wall 112 of the container 110 and the exposed upper parts of the sidewall 115 around the access opening 130 of the container 110. The liner 170 is preferably held in contact with the upper sidewall 115 and bottom wall 112 by heat sealing the liner surfaces to those walls. The liner 170 surfaces may also be glued or otherwise adhered to the sidewall 115 and bottom wall 112 and insulator layer 150. Alternatively, sidewall 115 and bottom wall 112 as wells as the liner 170 may be of unitary molded construction and be retrofilled with an insulating medium by injection.

As mentioned above, the interior liner 170 preferably comprises a thin layer of liquid impermeable, thermally conductive material in contact with the interior surface of the container 110. The liner 170 may therefor contain a cooling medium such as cold water, ice in a variety of shapes, gel packs and the like. The impermeable liner 170 contains most preferably ice in a convenient form such as cubes, slabs or even a solid block conforming to and fitting securely within the liner 170. The cooling medium may also comprise a cylindrical shaped mass of ice inserted into the liner 170. Because the liner 170 is thermally conductive, the coolness of the medium within the interior volume 120, may be conducted to a container in contact with the non-insulated portions of the exterior surface of the liner 170.

The exterior surface 170*a* of the interior liner 170 directly opposite the aperture 160 in the sidewall 115 of the container 110 forms a compartment 175 for storage of a beverage container and beverage container holder 180. In the preferred embodiment of the compartment 175 and liner 170, the liner 170 curves inwardly towards the central part of the interior volume 120. The inward curve forms a compartment 175 interior wall 176 having a concave surface adapted to receive and contact a beverage container therein. The concave compartment 175 preferably conforms with the exterior surface of a beverage container, i.e., forming a cylindrical compartment 175 for a can, bottle or the like. Alternatively, the liner 170 forming the interior wall 176 of the compartment 175 may be semi-rigid, wherein the liner 170 and interior wall 176 deform in response the force if the cooling medium on one side of the liner 175. The semi-rigid liner design also allows the liner 175 to deform in response to the beverage container against the interior wall 176 of the compartment 175. This semi-rigid construction allows for insertion, retention and cooling of a great variety of shapes of beverage containers within the compartment 175.

Figure 3:
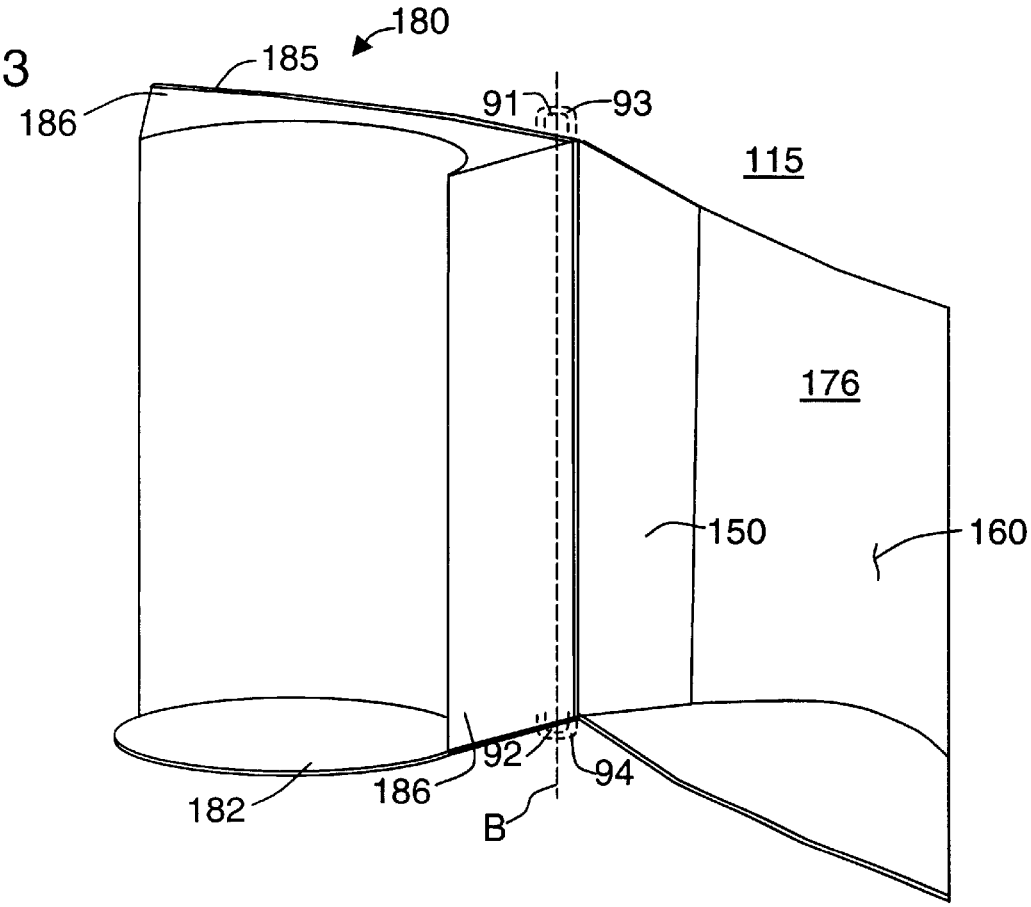
FIG. 3 is a perspective view of the preferred embodiment of a extendable beverage container holder having a curved exterior wall and in the extended position from the cooler compartment of the cooler in FIG. 2.
Figure 4:
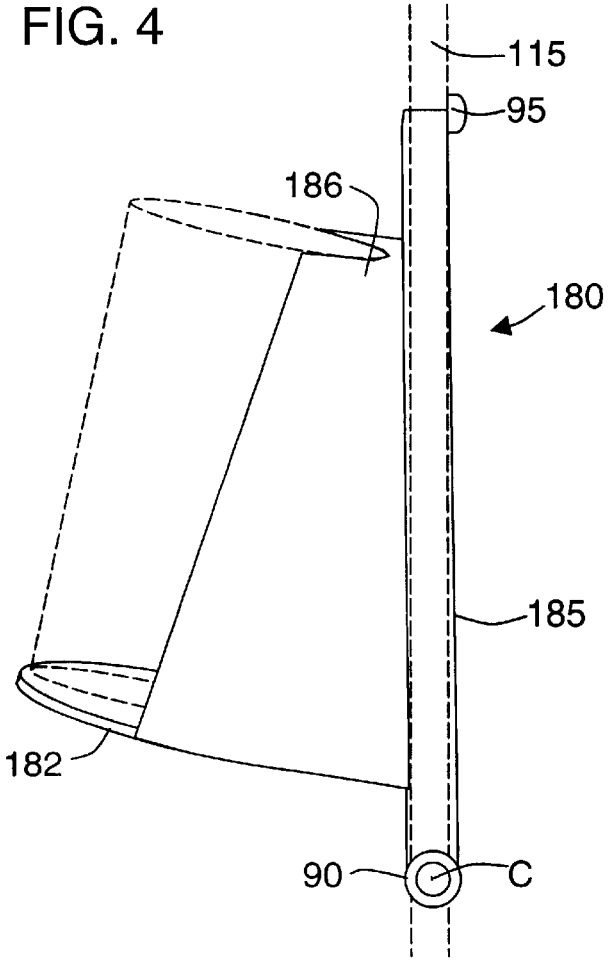
FIG. 4 is an elevation view of another embodiment of the invention showing a bottom-hinged extendable beverage container holder in the stowed position and showing the container wall and beverage container in ghost.
Figure 5:
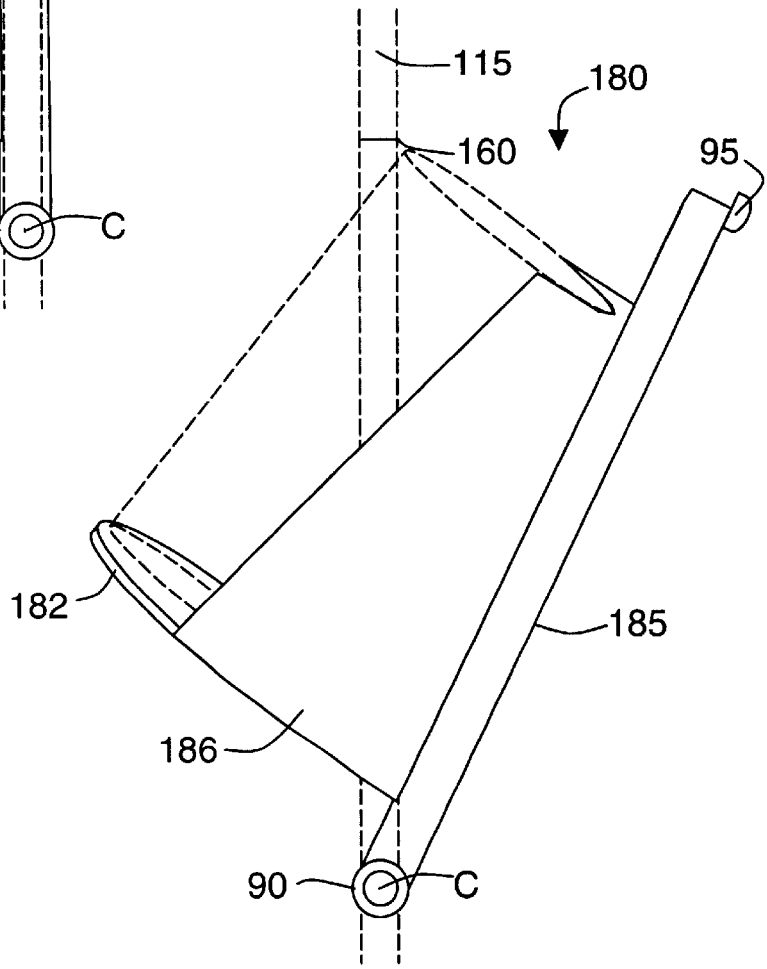
FIG. 5 is an elevation view of the bottom-hinged extendable beverage container holder of FIG. 8*a* in the extended position showing the container wall and beverage container in ghost.

The compartment 175 is not only adapted to receive a beverage container therein, but also an extendable beverage container holder 180 as in FIGS. 3–5. More specifically, as shown in FIG. 3, a beverage container holder 180 comprises an exterior wall 185 bonded to a holder bottom wall 182 and an insulative holder wall 186. The exterior wall 185 and bottom wall 182 of the beverage container holder 180 are preferably made of a rigid high density plastic. More specifically, the exterior wall 185 and bottom wall 182 are preferably constructed of a durable, liquid non-permeable and thermally insulative material such as polyurethane, thermoplastic and other durable materials. Preferably the exterior wall 185 and bottom wall 182 of the beverage container holder 180 are of unitary construction by means of molding such as cast or injection molding of thermoplastic materials.

Referring to FIGS. 4 and 5, an alternate beverage container holder 180 similarly comprises an exterior wall 185 bonded to a holder bottom wall 182 and an insulative holder wall 186. The exterior wall 185 and bottom wall 182 of the beverage container holder 180 are preferably made of a rigid high density plastic. More specifically, the exterior wall 185 and bottom wall 182 are preferably constructed of a durable, liquid non-permeable and thermally insulative material such as polyurethane, thermoplastic and other durable materials. Preferably the exterior wall 185 and bottom wall 182 of the beverage container holder 180 are of unitary construction by means of molding such as cast or injection molding of thermoplastic materials.

As shown in FIGS. 3 and 4, the exterior walls 185 are of essentially the same dimensions and preferably slightly small dimensions as the aperture 160 in order to fit securely within an aperture 160. For example, as in FIGS. 2 and 3, the exterior wall 185 of the beverage container holder 180 in the sidewall 115 is of curved construction in order to transition uniformly to the wall 115 adjacent the aperture 160. To facilitate the smooth transition, the radius of curvature of the exterior wall 185 of the beverage container holder 180 is substantially equal to or slightly less than the radius of curvature of the container sidewall 115.

Referring now to FIGS. 2–5: The beverage container holder 180 is adapted to be placed in a stowed position and one or more extended positions as in FIG. 2). To this end, each beverage container holder 180 has means to allow the holder 180 to be placed and retained in those two positions. For example, the beverage container holder 180 in the sidewall 115 of the cooler 1 may be pulled out or pushed in on drawer tracks 167 and 168. Although track means 167 and 168 are contemplated to be within the scope of extending means, the preferred embodiment of the invention uses pivoting or hinge means for extension and stowage of the beverage container holder 180.

Figure 11:
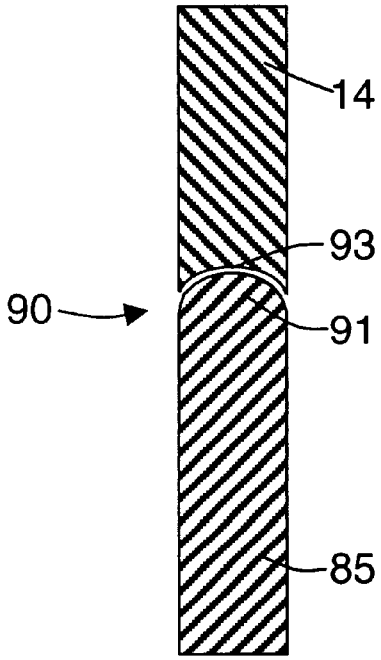
FIG. 11 is a cross-sectional elevation view showing a peg and recess type pivot/hinge mechanism for the beverage container holder.

Referring again to FIGS. 2 and 3: The beverage container holder 180 in the top left aperture 160 shows an example of preferred pivoting means 90 for the beverage container holders 180. As can be seen in the Figures, it is preferred that the beverage container holder 180 pivots about one side of the exterior wall 185 thereof. A variety of methods of pivoting means 90 are available, such as hinges molded both into the sidewall 115 and the exterior wall 185 of the beverage container holder 180. The simplest and most preferred hinge mechanism 90 is shown in FIGS. 3 and 11. Such hinge mechanism 90 includes pips 91 and 92 located on opposing corners of the wall exterior 185 and recesses 93 and 94 in the sidewall 115 adapted to receive and retain the pips 91 and 92 respectively therein. The pips 91 and 92 are integrally molded with the exterior wall 185 of the beverage container holder 180 and the recesses 93 and 94 are preferably integrally molded into the wall 115 of the container 110 adjacent the aperture 160. The material of construction of the container walls 115 and exterior wall 185 are sufficiently elastic to allow the pips 91 and 92 may be snapped into the recess 93 and 94, but sufficiently rigid to retain the pips 91 and 92 within the recesses 93 and 94 respectively. The pips 91 and 92 and recesses 93 and 94 are thus aligned along a vertical axis B allowing the beverage container holder 180 to rotate or pivot about the vertical axis between a stowed and a extended position. Although the pip and recess pivot means 90 is preferred, other more complex means are contemplated such as one ore more multi-part hinges with or without a removable hinge pin, or even a piece of flexible plastic connecting one vertical side of the exterior wall 185 to the edge of an aperture 160. In another pivoting embodiment, as shown in the bottom left aperture of the cooler 1, the beverage container holder 180 may pivot about a vertical axis not aligned with a side edge of the holder 180 exterior wall, but an axis through the top and bottom edges of the exterior wall. A holder 180 rotating on an off-edge axis such as this operates in a similar manner to a rotating door.

Referring not to FIGS. 2 and 4–5: While in the preferred embodiment of the invention the beverage container holders 180 pivot about a vertical axis B, it is also contemplated that the pivot mechanism 90 may be pivotable about a horizontal axis C at the bottom of the aperture 160 and the exterior wall 185 of the beverage container holder 180. It is preferable for the pivot mechanism 90 to be vertically aligned rather than horizontally aligned because the beverage container holder 180 may be extended while maintaining a beverage therein in a horizontal position. The beverage container holder 180 of FIG. 4 and 5 shows that a beverage container in the holder 180 is tipped when the beverage container holder 180 is placed in the extended position. Furthermore, as shown in FIGS. 4 and 5, the beverage may be tipped off horizontal in the stowed position in order to allow the container to be more easily accessible in the extended position. More specifically, the bottom wall 182 of the holder 180 is topped off horizontal in order that beverage container may be accessible (i.e., extending beyond the side wall 115) while the holder need not be extended as far from the container side wall 115 as would be necessary in the bottom wall 182 were horizontal.

Figure 10:
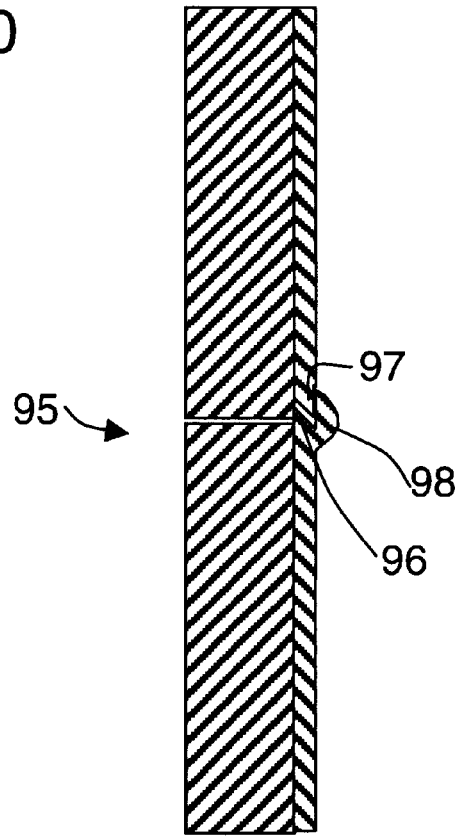
FIG. 10 is a cross-sectional elevation view of a latching mechanism for the beverage container holder.

Referring to FIG. 10. Each beverage container holder 180 preferably has latching means 95 thereon, allowing the beverage container holder 180 to be retained securely in the stowed position. Preferably, the latching means 95 is located on an edge of the exterior wall 185 of the beverage container holder 180 and the adjacent edge of the aperture 160, and most preferably on the exterior wall 185 and aperture 160 edges opposite the pivot means 90. The latching means 95 preferably comprises the simplest and most economical means similar to the pivoting means 90. Namely, the latching means 95 is preferably similar to a pip 91 and recess 93. The latching edge of the exterior wall 185 preferably has a rib 96 thereon which may latch by snapping into a groove 97 in the adjacent wall in the aperture 160. A tab 98 adjacent the rib 96 may also be provided to act as a stop for the beverage holder exterior wall 185 against the sidewall 115. The tab 98 also acts as means for opening or extending the beverage container holder 180 from the stowed position such as by pulling on the tab 98 with a finger. It is also contemplated that other latching means may be used such as hook and eye, hasp, snap buttons, and a variety of other conventional latching means.

Referring again to FIGS. 3 through 5: The beverage container holder 180 also comprises an insulative holder wall 186 and bottom wall 182 adjacent the exterior wall 185. In the holder 180 of FIG. 3, the bottom wall 182 comprises a substantially horizontal surface attached to substantially perpendicularly to the exterior wall 185 and is of sufficient size and durability to retain a beverage container thereon. The holder of FIG. 4 however comprises a similar bottom wall 182, with the exception that the bottom wall 182 is attached at an angle with the exterior wall, i.e., an acute angle towards the top of the exterior wall 185. Most preferably, the bottom wall 182 has a substantially semicircular shape, the interior portion (i.e., the portion towards the central volume 120 and liner exterior wall 176) of which comprises a rounded portion conforming to the circumference of a beverage container thereon. The thermally insulative holder wall 186 provides additional thermal insulation between the compartment 175, and the exterior wall 185 and external environment. Exemplary thermal insulators include lightweight foam insulation such as STYROFOAM. The insulator may also comprise the exterior wall 185 formed as a thermoplastic shell around an insulative material such as solid, foam or even gaseous insulation therein.

The insulative holder wall 186 is also adapted to help retain a beverage container. The insulative holder wall 186 preferably has a concave vertical surface adapted to securely retain a container primarily along the vertical direction, whereas the bottom wall 182 of the beverage container holder primarily retains the beverage container horizontally. As can be seen in FIGS. 3 and 5, the insulative holder wall 186, the liner exterior wall 176 and the bottom wall 182 together form a substantially cylindrical compartment 175 for retention of a beverage container. When the beverage container holder 180 is placed in the stowed position, the insulative holder wall 186 as well as the latching mechanism 195 keeping the beverage container holder 180 closed, place the beverage container within the compartment 175 into thermally conductive contact with the liner 170 and thereby with the cooling medium therein. Also, when the beverage container holder 180 is in the stowed position, the top of the beverage container is kept out of contact with the external environment, thus prevent warming of the beverage or contamination of an opened beverage by insects, dirt and the like.

Thus, the cooler 1 allows a user to fill the interior volume 120 of the container 110 with a cooling medium within the thermally conductive liner 170. Food and beverages may be placed in the interior volume 120 to keep them cool. Additionally, beverage containers may also be placed in the compartments 175 to keep them cool by thermally conductive contact with the cooling medium through the liner 170. The beverages may be accessed and consumed by opening the beverage container holders 180 into the extended position. Opened or closed beverage containers may be kept cool and contaminant free by returning the beverage container holder 180 to its stowed position.

Figure 6:
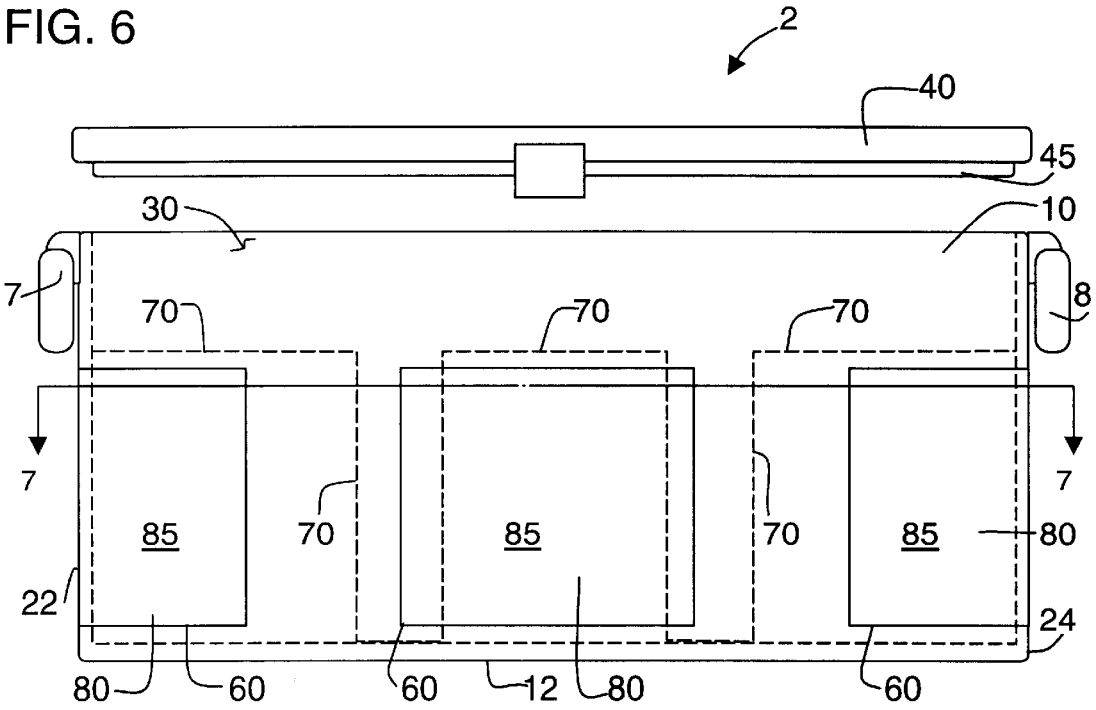
FIG. 6 is an elevation view of a substantially rectangular cooler constructed in accordance with another embodiment of the invention showing the interior lining in ghost.
Figure 7:
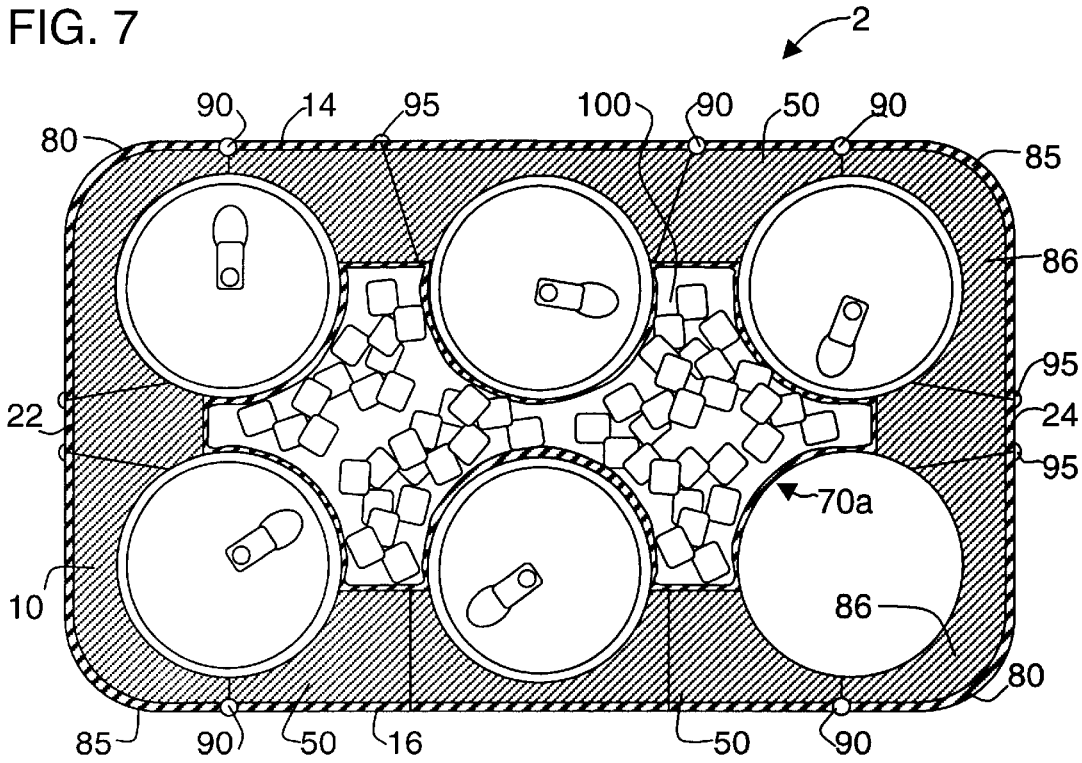
FIG. 7 is a cross-sectional view of the cooler along line 7—7 of FIG. 6 showing the interior liner, beverage storage compartments and beverage container holders.

Referring now to FIGS. 6 and 7: Another embodiment of the cooler 2 depicted in FIGS. 6 and 7 is representative of a cooler 2 with a substantially rectangular cross-section in both the plan and elevation view. Specifically, the cooler 2 includes an insulated container 10 having a rectangular bottom wall 12 with a rectangular rear wall 14, a rectangular front wall 16 and a pair of rectangular sidewalls, 22 and 24, extending upwardly therefrom. The pair of sidewalls 22 and 24 form a first sidewall 22 and a second sidewall 24. The first and second sidewalls 22 and 24 are integral with and perpendicular to the rear and front walls 14 and 16. These walls 12, 14, 16, 22 and 24 are joined at their respective peripheries to form an essentially rectangularly prismatic container 10 configured to form an enclosure defining a volume 100 and having a top access opening 30 therein. As shown in FIGS. 6 and 7, the walls may be joined to each other having a slight radius, wherein corner are rounded for safety and aesthetic purposes.

The container 10 is preferably made of a rigid high density plastic. More specifically, the container walls 12, 14, 16, 22 and 24 are preferably constructed of a durable, liquid non-permeable and thermally insulative material such as polyurethane, thermoplastic and other durable materials. Preferably the container 10 is of unitary construction by means of molding such as cast or injection molding of thermoplastic materials.

The container 10 also comprises a lid 40 adapted for removable attachment to and covering of the upper container access opening 30. The lid 40 is adapted to fit within the upper container access opening 30, such adaptation being a tight frictional fit wherein a side flange 45 of the lid 40 fits over, and in contact with the interior of the container front, rear and side walls 14, 16, 22 and 24. The lid 40 is also constructed of a durable, liquid non-permeable and thermally insulative material such as rigid high density plastic, polyurethane, thermoplastic and other durable materials and combinations thereof. Preferably the lid 40 is of unitary construction by means of molding such as injection molding of thermoplastic materials. The lid 40 may also comprise a thermoplastic material as a shell formed around an insulative material such as solid, foam or even gaseous insulation therein. The lid 40 may further be removable from the container access opening 30 as shown or may be otherwise removably attached with hinges, straps or the like (not shown). The lid 40 is preferably of substantially solid construction to allow the lid 40 to have significant weight rested thereon for use as a table or chair and the like. The cooler 2 may also have a removeable tray (not shown) inserted in the access opening 30 as described herein above for the cooler 1 of FIG. 1.

The cooler 2 may have handles 7 and 8 attached to the exterior sidewalls 22 and 24. These handles 7 and 8 may be of the types that are rotatably mounted to the upper part of the sidewalls 22 and 24 to rotate away from the sidewalls 22 and 24 for gripping the handles 7 and 8 without contacting the exterior surface of the container 10. Alternatively the handles 7 and 8 may be integrally molded grip holes (not shown) in the sidewalls 22 and 24 of the container 10. Additional handles (not shown) may also mounted on the exterior of the container 10 on the sidewalls 22 and 24, front and rear walls 14 and 16, on either the upper lower or central portions of these walls 14, 16, 22 and 24, or even on the lid 40.

The container 10 preferably has a thermally insulative layer 50 attached to the interior of each front, rear and side wall 14, 16, 22 and 24. A thermal insulator 50 may also line the bottom wall 12 of the container 10. The thermally insulative layer 50 provides additional thermal insulation between the interior volume 100 of the container 10 and the external environment. Exemplary thermal insulators include lightweight foam insulation such as STYROFOAM. The insulation 50 interior to the container 10 may also comprise the walls 14, 16, 22 and 24 formed as a thermoplastic shell around an insulative material such as solid, foam or even gaseous insulation therein.

Figure 8:
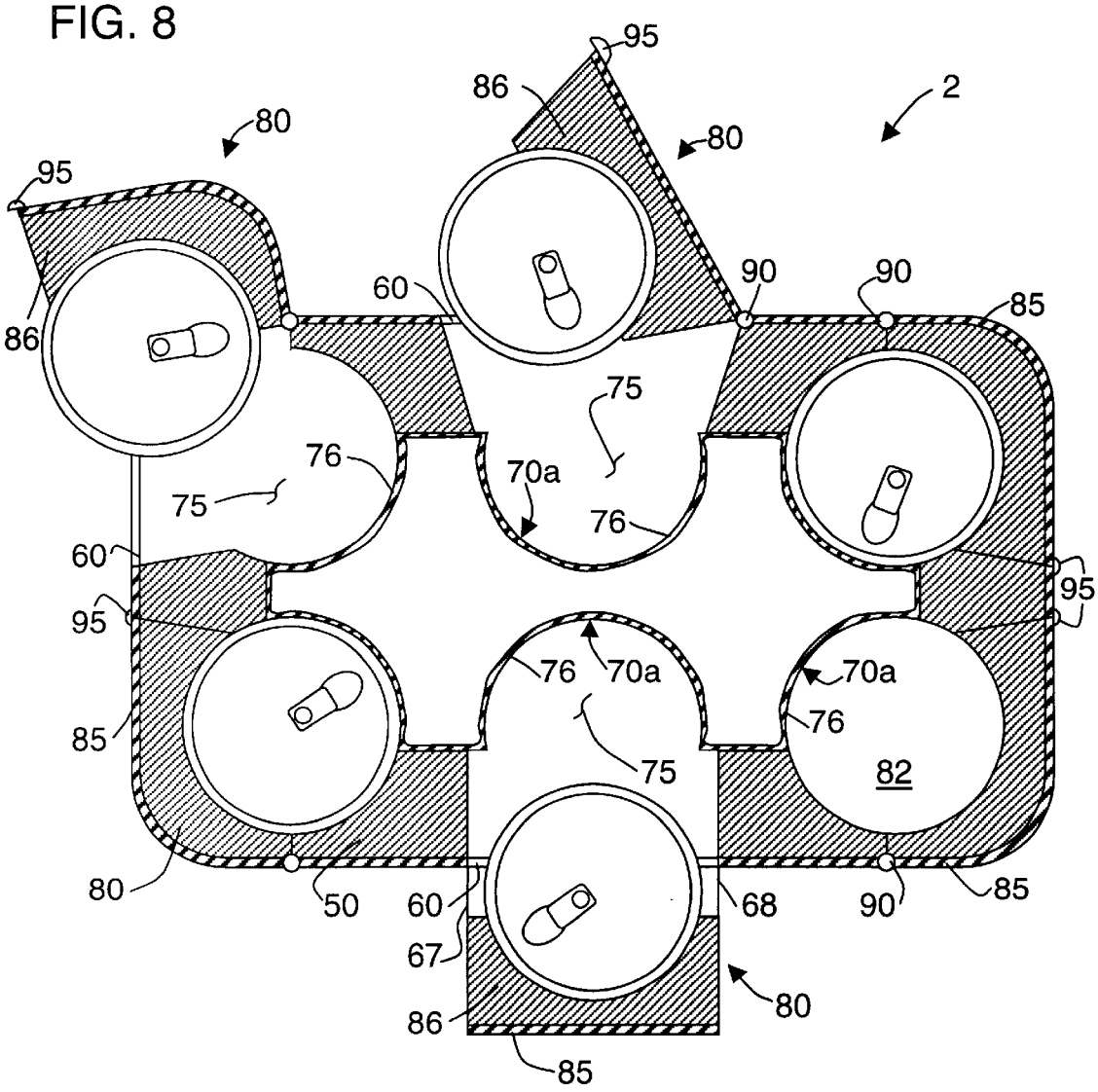
FIG. 8 is a cross-sectional plan view of the cooler in FIG. 6 showing the beverage storage compartments and several embodiments of the beverage container holders in the extended or opened position.

Referring now to FIGS. 7 and 8: The exterior walls 14, 16, 22 and 24 of the container 10 have one or more apertures 60 therein. More specifically, the aperture 60 comprises a hole forming a door-like opening extending from the exterior environment through the wall 14, 16, 22 or 24 and through the insulative layer 50 and towards the central volume 100 of the container 10. For example, as shown in FIGS. 7 and 8, the front wall 14 of the container 10 has a substantially rectangular aperture 60 extending therethrough. Preferably, the aperture 60 is large enough to place a standing beverage container therethrough. Furthermore, it is preferred that the aperture 60 extends through the wall(s) in close proximity to the bottom wall 12. This allows a container to be placed in through the aperture 60 with the bottom wall 12 giving support to the container or the container holder, discussed herein below.

The container 10 further comprises and interior liner 70 adjacent the insulator layer 50 and the apertures 60. More specifically, the interior liner 70 preferably comprises a thin layer of liquid impermeable, thermally conductive material in contact with the interior surface of the insulator layers 50. The liner 70 is also in contact with the bottom wall of the container and the exposed upper parts of the side walls 14, 16, 22 and 24 around the access opening 30 of the container 10. The liner 70 is preferably held in contact with the upper front, rear and side walls 14, 16, 22 and 24 and bottom wall 12 by heat sealing the liner surfaces to those walls. The liner 70 surfaces may also be glued or otherwise adhered to front, rear and side walls 14, 16, 22 and 24 and bottom wall 12 and insulator layer 50. Alternatively, the front, rear and side walls 14, 16, 22 and 24 and bottom wall 12 as wells as the liner may be of unitary molded construction and be retro-filled with an insulating medium by injection.

As mentioned above, the interior liner 70 preferably comprises a thin layer of liquid impermeable, thermally conductive material in contact with the interior surface of the container 10. The liner 70 may therefor contain a cooling medium such as cold water, ice in a variety of shapes, gel packs and the like. The impermeable liner 70 contains most preferably ice in a convenient form such as cubes, slabs, cylinders or even a solid block conforming to and fitting securely within the liner 70. Because the liner is also thermally conductive, the coolness of the medium within the interior volume 100, may be conducted to a container in contact with the non-insulated portions of the exterior surface of the liner 70.

The exterior surface 70*a* of the interior liner 70 directly opposite the aperture 60 in the wall 14, 16, 22 or 24 of the container 10 forms a compartment 75 for a beverage container and beverage container holder 80. In the preferred embodiment of the compartment 75 and liner 70, the liner 70 curves inwardly towards the central part of the interior volume 100. The inward curve forms a compartment interior wall 76 having a concave surface adapted to receive and contact a beverage container therein. The concave compartment 75 preferably conforms with the exterior surface of a beverage container, i.e., forming a cylindrical compartment 75 for a can, bottle or the like. Alternatively, the liner 70 forming the interior wall 76 of the compartment 75 may be semi-rigid, wherein the liner 70 and interior wall 76 deform in response the force if the cooling medium on one side of the liner 75. The semi-rigid liner design also allows the liner 75 to deform in response to the beverage container against the interior wall 76 of the compartment 75. This semi-rigid construction allows for insertion, retention and cooling of a great variety of shapes of beverage containers within the compartment 75.

The compartment 75 is not only adapted to receive a beverage container therein, but also a extendable beverage container holder 80. More specifically, as shown in FIGS. 6 through 8, a beverage container holder 80 comprises an exterior wall 85 bonded to a holder bottom wall 82 and an insulative holder wall 86. The exterior wall 85 and bottom wall 82 of the beverage container holder 80 are preferably made of a rigid high density plastic. More specifically, the exterior wall 85 and bottom wall 82 are preferably constructed of a durable, liquid non-permeable and thermally insulative material such as polyurethane, thermoplastic and other durable materials. Preferably the exterior wall 85 and bottom wall 82 of the beverage container holder 80 are of unitary construction by means of molding such as cast or injection molding of thermoplastic materials.

Figure 9:
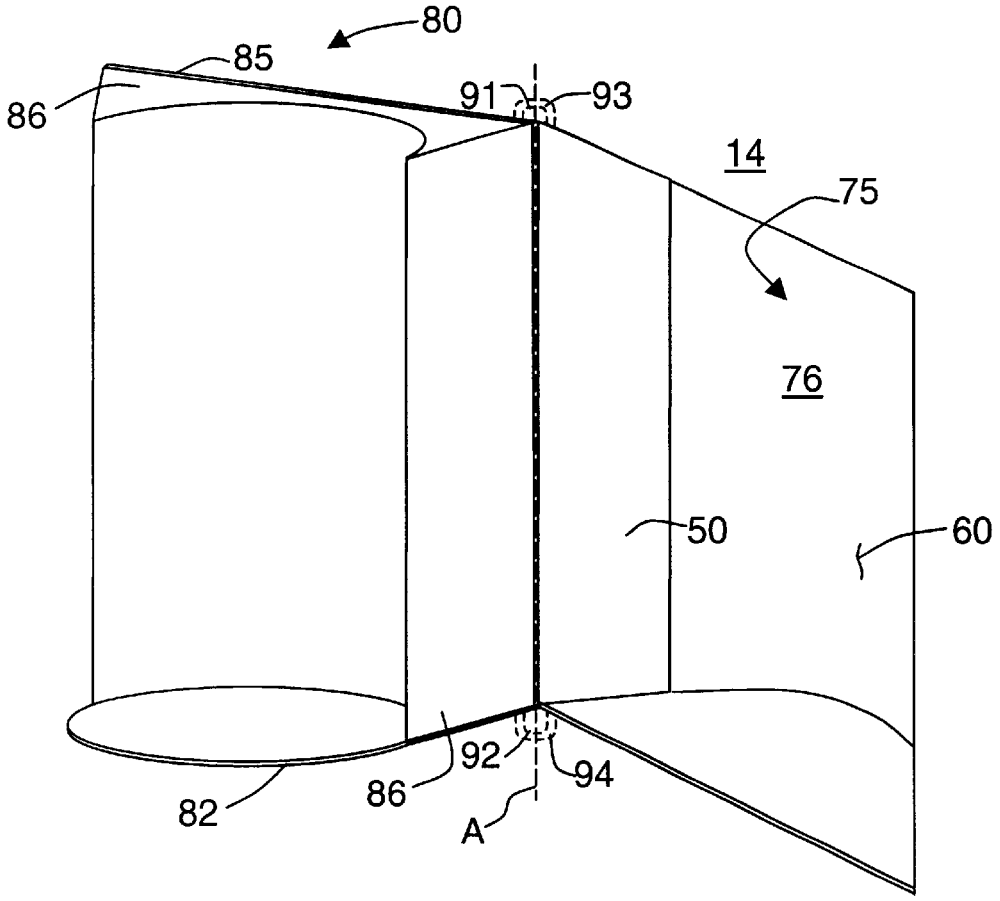
FIG. 9 is a perspective view of another embodiment of an extendable beverage container holder having a flat exterior wall and in the extended position from the cooler compartment of FIG. 6.

As shown in FIG. 9, the exterior wall 85 is of essentially the same dimensions and preferably slightly small dimensions as the aperture 60 in order to fit securely within an aperture 60. For example, as in FIGS. 7 and 8, the exterior wall 85 of the beverage container holder 80 in the center of a rear or front wall 14 or 16 is of flat construction in order to transition uniformly to the wall 14 or 16 adjacent the aperture 60. Also as can be seen in FIGS. 7 and 8, a beverage container holder 80 may also be located in an aperture 60 on a corner adjacent a front or rear wall 16 or 14 and a side wall 22 or 24. For example, a beverage container holder 80 on a corner aperture 60 such as the corner adjacent the front and right side walls 16 and 24, therefor has an exterior wall 85 shaped like and conforming to the corner aperture 60 and transitioning smoothly to the adjacent walls 16 and 24. Furthermore, the beverage container holder 80 may also comprise a design such as the holder 180 of FIGS. 3 through 5.

Referring now to FIGS. 5 and 6: Whether the beverage container holder 80 is in a front, rear or corner aperture 60 of the container 10, it is preferred that the beverage container holder 80 is adapted to be placed in a stowed position (as in FIG. 7) and one or more extended positions (as in FIG. 8). To this end, each beverage container holder 80 has means to allow the holder to be placed and retained in those two positions. For example, the beverage container holder 80 in the front wall of the cooler 2 of FIG. 6 may be pulled out or pushed in on drawer tracks 67 and 68. Although track means 67 and 68 are contemplated to be within the scope of extending means, the preferred embodiment of the invention uses pivoting or hinge means for extension and stowage of the beverage container holder 80.

Referring now to FIGS. 7 through 9: The beverage container holders 80 in the rear wall 14 aperture 60 and left rear corner aperture 60 show examples of preferred pivoting means 90 for the beverage container holders 80. As can be seen in the Figures, it is preferred that the beverage container holder 80 pivots about one side of the exterior wall 85 thereof. FIG. 8 illustrates a cross-sectional elevation of a variety of places for edges along which the beverage containers may pivot along a vertical axis. A variety of methods of pivoting means 90 are available, such as hinges molded both into the wall 14, 16, 22 or 24 and the exterior wall 85 of the beverage container holder 80. The simplest and most preferred hinge mechanism 90 is shown in FIGS. 9 and 11. Such hinge mechanism 90 includes pips 91 and 92 located on opposing corners of the wall exterior 85 and recesses 93 and 94 in the wall 14, 16, 22 or 24 adapted to receive and retain the pips 91 and 92 respectively therein. The pips 91 and 92 are integrally molded with the exterior wall 85 of the beverage container holder 80 and the recesses 93 and 94 are preferably integrally molded into the wall 14, 16, 22 or 24 of the container 10 adjacent the aperture 60. The material of construction of the container walls 14, 16, 22 and 24 and exterior wall 85 are sufficiently elastic to allow the pips 91 and 92 may be snapped into the recess 93 and 94, but sufficiently rigid to retain the pips 91 and 92 within the recesses 93 and 94 respectively. The pips 91 and 92 and recesses 93 and 94 are thus aligned along a vertical axis A allowing the beverage container holder to rotate or pivot about the vertical axis between a stowed and a extended position. Although the pip and recess pivot means 90 is preferred, other more complex means are contemplated such as one ore more multi-part hinges with or without a removable hinge pin, or even a piece of flexible plastic connecting one vertical side of the exterior wall 85 to the edge of an aperture 60. It is also contemplated that the pivot mechanism 90 may be pivotable about a horizontal axis (as in FIGS. 4 and 5) at the bottom of the aperture 60 and the exterior wall 85 of the beverage container holder 80.

Referring to FIGS. 7 through 9: Each beverage container holder 80 preferably has latching means 95 thereon, allowing the beverage container holder 80 to be retained securely in the stowed position. Preferably, the latching means 95 is located on an edge of the exterior wall 85 of the beverage container holder 80 and the adjacent edge of the aperture 60, and most preferably on the exterior wall 85 and aperture 60 edges opposite the pivot means 90. The latching means 95 preferably comprises the simplest and most economical means similar to the pivoting means 90. Namely, the latching means 95 is preferably similar to a pip 91 and recess 93. The latching edge of the exterior wall 85 preferably has a rib 96 thereon which may latch by snapping into a groove 97 in the adjacent wall in the aperture 60. A tab 98 adjacent the rib 96 may also be provided to act as a stop for the beverage holder exterior wall 85 against the wall 14, 16, 22 or 24. The tab 98 also acts as means for opening or extending the beverage container holder 80 from the stowed position such as by pulling on the tab 98 with a finger. It is also contemplated that other latching means may be used such as hook and eye, hasp, snap buttons, and a variety of other conventional latching means.

Referring again to FIGS. 7 through 9. The beverage container holder 80 also comprises an insulative holder wall 86 and bottom wall 82 adjacent the exterior wall 85. The bottom wall 82 comprises a substantially horizontal surface attached to substantially perpendicularly to the exterior wall and is of sufficient size and durability to retain a beverage container thereon. Most preferably, the bottom wall has a substantially semicircular shape, the interior portion (i.e., the portion towards the central volume 100 and liner exterior wall 76) of which comprises a rounded portion conforming to the circumference of a beverage container thereon. The thermally insulative holder wall 86 provides additional thermal insulation between the compartment 75, and the exterior wall 85 and external environment. Exemplary thermal insulators include lightweight foam insulation such as STYROFOAM. The insulator may also comprise the exterior wall 85 formed as a thermoplastic shell around an insulative material such as solid, foam or even gaseous insulation therein.

The insulative holder wall 86 is also adapted to help retain a beverage container. The insulative holder wall 86 preferably has a concave vertical surface adapted to securely retain a container primarily along the vertical direction, whereas the bottom wall 82 of the beverage container holder retains the beverage container primarily horizontally. As can be seen the insulative holder wall 86, the liner exterior wall 76 and the bottom wall 82 together form a substantially cylindrical compartment 75 for retention of a beverage container. When the beverage container holder 80 is placed in the stowed position, the insulative holder wall 86 as well as the latching mechanism 95 keeping the beverage container holder 80 closed, place the beverage container within the compartment 75 into thermally conductive contact with the liner 70 and thereby with the cooling medium therein. Also, when the beverage container holder 80 is in the stowed position, the top of the beverage container is kept out of contact with the external environment, thus prevent warming of the beverage or contamination of an opened beverage by insects, dirt and the like.

Thus, the cooler 2 allows a user to fill the interior volume 100 of the container 10 with a cooling medium within the thermally conductive liner 70. Food and beverages may be placed in the interior volume 100 to keep them cool. Additionally, beverage containers may also be placed in the compartments 75 to keep them cool by thermally conductive contact with the cooling medium through the liner 70. The beverages may be accessed and consumed by opening the beverage container holders 80 into the extended position. Opened or closed beverage containers may be kept cool and contaminant free be returning the beverage container holder 80 to it s stowed position.

While the above description contains many specificities, these should not be construed as limitations on the scope of the invention, but rather as an exemplification of one preferred embodiment thereof, particularly in light of the foregoing teachings. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Reasonable variations and modifications are possible within the scope of the foregoing disclosure of the invention without departing from the spirit of the invention. Many other variations are possible, for example:

The cooler need not be cylindrical or a rectangular prism, but a wide variety of other container configurations are possible.

The cooler may hold several beverages such as the cooler shown that has six compartments or may have as few as one compartment up to many more.

The cooler may have beverage container holders in a vertically spaced configuration in the sidewalls as well as horizontally spaced.

A variety of cooling media may be used such as ice cubes, ice blocks, gel packs, dry ice, cold water or other appropriate media capable of thermally conducting to items desired to be cool.

The beverage container holders may be configured to hold cylindrical containers such as cans or bottles and may hold a variety of other containers including square cartons or other shapes of beverage and food containers.

The beverage container holders may be configured to extend by pivoting at a side or bottom edge, or may extend as a drawer, or may be rotatable about a central axis coincident with the beverage container center (like a rotating door).

The cooler may have as few as one to very many handles for carrying of the cooler.

What is claimed is:

1. A cooler, comprising:

a cooler container, said cooler container comprising;

a bottom wall having a periphery;

at least one side wall having a top edge, a bottom edge and an interior and an exterior surface, said bottom edge of said at least one side wall being connected to said bottom wall about said periphery;

said cooler container having an upper access opening defined by said top edge of said at least one side wall and an interior volume defined by said space between said bottom wall and said at least one sidewall interior surface; and a first thermally insulative layer adjacent said at least one sidewall interior surface;

said sidewall and said first thermally insulative layer having an aperture extending through from said sidewall exterior surface to said interior volume and having an aperture periphery;

a container lid having substantially the same periphery as said cooler bottom wall, said cooler lid being adapted for retention in said upper access opening against said at least one sidewall interior surface;

a liquid impermeable, thermally conductive interior liner within said interior volume of said container adjacent said first insulative layer and said aperture, said liner being adapted to receive a cooling medium; and a extendable beverage container holder adapted to retain a beverage container being extendably mounted in said aperture;

wherein said extendable beverage container holder is adapted to placed in a first extended position wherein said extendable beverage container holder and a beverage therein are substantially exterior to said interior volume;

and wherein said extendable beverage container holder is adapted to placed in a second stowed position wherein said extendable beverage container holder and a beverage therein are substantially interior to said interior volume, thereby placing said beverage container in contact with said interior liner.

2. The cooler according to claim 1, wherein said bottom wall periphery is substantially circular and said at least one sidewall comprises a substantially cylindrical sidewall.

3. The cooler according to claim 1, wherein said bottom wall periphery is substantially rectangular;

and wherein said at least one sidewall comprises first, second, third and fourth sidewalls connected about said periphery of said substantially rectangular bottom wall;

said first sidewall being connected to said second sidewall and said fourth sidewall;

said third sidewall being connected to said second sidewall and said fourth sidewall opposing said first sidewall.

4. The cooler according to claim 2, wherein said extendable beverage container holder is pivotably mounted to said substantially cylindrical sidewall adjacent said aperture periphery.

5. The cooler according to claim 4, wherein said extendable beverage container holder further comprises:

an exterior wall having an exterior wall periphery and a bottom portion; and a bottom wall attached along said bottom portion of said exterior wall;

said exterior wall and said bottom wall being adapted to retain a beverage container.

6. The cooler according to claim 5, wherein said extendable beverage container holder further comprises:

a second thermally insulative layer adjacent said exterior wall and said bottom wall;

said second thermally insulative layer being adapted to retain said beverage container;

said second thermally insulative layer being adjacent said first thermally insulative layer when said extendable beverage container holder is in second stowed position;

whereby said first and second thermally insulative layers thermally insulate said beverage container and said interior volume from an environment exterior to said interior volume.

7. The cooler according to claim 6, wherein said aperture periphery comprises a first substantially rectangular periphery having a top edge, a bottom edge and first and second side edges;

and wherein said exterior wall periphery comprises a second substantially rectangular periphery having a top edge, a bottom edge and first and second side edges;

and wherein said exterior wall first side edge is pivotably mounted to said aperture first side edge along a first vertical axis of rotation.

8. The cooler according to claim 6, wherein said aperture periphery comprises a first substantially rectangular periphery having a top edge, a bottom edge and first and second side edges;

and wherein said exterior wall periphery comprises a second substantially rectangular periphery having a top edge, a bottom edge and first and second side edges;

and wherein said exterior wall bottom edge is pivotably mounted to said aperture bottom edge along a horizontal axis of rotation.

9. The cooler according to claim 6, wherein said aperture periphery comprises a first substantially rectangular periphery having a top edge, a bottom edge and first and second side edges;

and wherein said exterior wall periphery comprises a second substantially rectangular periphery having a top edge, a bottom edge and first and second side edges;

and wherein said exterior wall top and bottom edges are pivotably mounted to said aperture top and bottom edges along a second vertical axis of rotation.

10. The cooler according to claim 7, further comprising:

latching means for securing said extendable beverage container holder in said second stowed position.

11. The cooler according to claim 10, wherein said latching means comprises:

a groove in said aperture periphery; and a rib on said exterior wall periphery;

said rib being engageable with said groove to secure said beverage container holder in said stowed position.

12. The cooler according to claim 11, wherein said interior liner comprises:

a deformable bladder adapted to conform to a shape of said first thermally insulative layer, said extendable beverage container holder and a beverage within said extendable beverage container holder.

13. The cooler according to claim 11, wherein said interior liner comprises:

a semi rigid plastic liner adapted to substantially conform to a shape of said first thermally insulative layer, said extendable beverage container holder and a beverage within said extendable beverage container holder.

14. The cooler according to claim 13, further comprising:

a removeable tray for storage of goods within said interior volume of said cooler container;

said removeable tray being adapted to prevent contact of said goods with said cooling medium.

15. The cooler according to claim 14, wherein said removeable tray further comprises:

suspension means for engaging said tray with said at least one sidewall upper edge or said at least one sidewall interior surface;

said suspension means being adapted to suspend said tray within said interior volume between said access opening and said cooling medium.

* * * * *